US006009647A

United States Patent [19]

Feingold

[11] Patent Number: 6,009,647

[45] Date of Patent: Jan. 4, 2000

[54] DISPLAY DEVICE

[76] Inventor: Norman S. Feingold, 21 Tain Dr., Great Neck, N.Y. 11021

[21] Appl. No.: 09/089,814

[22] Filed: Jun. 3, 1998

Related U.S. Application Data

[63] Continuation-in-part of application No. 08/797,635, Feb. 7, 1997, Pat. No. 5,806,219.

[51] Int. Cl.[7] ..... G09F 13/00; G09F 19/00; G09F 11/02

[52] U.S. Cl. ..... 40/433; 40/474; 40/430

[58] Field of Search ..... 40/113, 433, 430, 40/435, 474, 483, 493, 494; 475/332, 337, 339

[56] References Cited

U.S. PATENT DOCUMENTS

| | | | |
|---|---|---|---|
| 489,027 | 1/1893 | McDonald | 40/34 |
| 620,689 | 3/1899 | Yaggy | 40/474 |
| 751,086 | 2/1904 | Lynn . | |
| 911,618 | 2/1909 | Schutz | 40/474 |
| 1,192,234 | 7/1916 | Simmen | 40/483 X |
| 1,311,601 | 7/1919 | Garami | 40/474 |
| 1,465,839 | 8/1923 | Carroll | 40/61 |
| 1,553,902 | 9/1925 | Jackson | 40/435 |
| 1,684,534 | 9/1928 | Campbell . | |
| 1,707,081 | 3/1929 | Fleak . | |
| 1,725,851 | 8/1929 | Craig . | |
| 1,822,798 | 9/1931 | Carroll | 40/61 |
| 1,851,585 | 3/1932 | Kliegl . | |
| 2,082,612 | 6/1937 | Bourgum | 40/34 |
| 2,154,532 | 4/1939 | Ryder | 475/332 |
| 2,205,937 | 6/1940 | Sullivan | 40/34 |
| 2,261,104 | 11/1941 | Birkigt | 475/332 |
| 2,360,536 | 10/1944 | Avery | 40/34 |
| 2,512,465 | 6/1950 | Moorhouse | 40/34 K |
| 2,527,803 | 10/1950 | Fleak | 40/34 |
| 2,586,641 | 2/1952 | Gabrielsen | 40/34 |
| 2,831,580 | 4/1958 | Carbone | 211/1.6 |
| 3,050,888 | 8/1962 | Myers et al. | 40/34 X |
| 3,155,430 | 11/1964 | Schindler | 40/34 X |
| 3,545,113 | 12/1970 | Babberl | 40/106.41 |
| 3,562,936 | 2/1971 | Schoenung | 40/34 X |
| 3,755,936 | 9/1973 | Terre et al. | 40/33 |
| 3,846,926 | 11/1974 | Sullivan | 40/44 |
| 4,166,401 | 9/1979 | Bohme et al. | 475/332 |
| 4,204,436 | 5/1980 | Heaton | 475/337 |
| 5,134,795 | 8/1992 | Wang | 40/411 |

*Primary Examiner*—Anthony Knight
*Assistant Examiner*—Marcus Dolce

[57] ABSTRACT

A display device consisting of a plurality of rotating segments each carrying elements of a message or sign, each rotating relative to each other, the center of rotation of each being concentric to each other. These segments are driven by a series of planetary gear systems or their equivalent, arranged in layers, each driving the next. To these segments may be attached a plurality of auxiliary devices, all driven by the same mechanism, which can enhance the attraction of the device, carry elements of the message, etc. Each segment or auxiliary device can be of a variety of shapes, colors, graphics, etc. Segments can be nested or overlapping, totally or in combination in any relation to each other. Message can be continuously or intermittently scrambled and unscrambled.

2 Claims, 2 Drawing Sheets

DISPLAY DEVICE

This application is a continuation-in-part of application Ser. No. 08/797,635 filed Feb. 7, 1997, and now U.S. Pat. No. 5,806,219.

BACKGROUND—FIELD OF INVENTION

The effectiveness of a mechanical display device, when used for signs or advertising, is determined in part by its ability to attract attention. This invention relates to a display device in which various basic and auxiliary segments move in relation to one another causing attraction to images of various messages, shapes, designs and colors.

BACKGROUND—DISCUSSION OF PRIOR ART

There are many previous attempts to achieve eye-catching display devices through the use of mechanically driven (usually powered by an electrical motor) segments, usually arranged equidistant from a center, using color, motion, transparent discs, masking and unmasking the display. Some of these are effective in attracting attention, but most are complicated in design, costly to build and of limited effectiveness. The later Sullivan patent uses many similar mechanical elements but they are assembled in a very different manner and perform different functions and results in a merchanism that masks and unmasks the display. Several clock designs are referenced, but these are very limited in their appeal being basically clocks with an added segment. The Babberl patent achieves the eye-catching objective by scrambling and unscrambling, but is also very limited in scope.

OBJECTS AND ADVANTAGES

Accordingly, several objects and advantages of my invention are to achieve a high degree of attraction to the display by a maximum use of movement, shapes, color, etc. and the ability to scramble and unscramble the segments of the display continuously or intermittently; to allow the use of many auxiliary segments in a variety of ways, to enhance its attraction, and to accomplish this with a single mechanism in a cost effective manner. This invention achieves these objectives with a minimum of mechanism used to create high levels of colorful movement. The result, with or without the optional movements, is a low cost method to attract the desired level of attention.

All segments of the display can be in substantially the same focal plane so that an observer may view the display without additional effort. However, each segment can be in its own plane to achieve other desired effects, if care is exercised in the design to avoid interference when in motion.

Applications can include advertising messages (single or multiple modules), clocks, point of purchase and window displays (where the products are the message), games, toys as well as educational material. There are also a multitude of artistic and decorative effects for which this device can be used.

The invention possesses other objects and features of advantage which, together with foregoing, will be specifically pointed out in the detailed description of the invention in conjunction with illustrative accompanying drawings hereunto annexed. It is to he understood that the invention is not to be limited to the specific form herein shown and described as various other embodiments thereof may be employed within the scope of the appended claim.

DESCRIPTION

This is a description of a family of mechanical devices consisting of a multiple of planetary gear systems, or equivalent, arranged in tandem (in layers) each driving subsequent ones, to produce dependent but controllable motions in a multiple of rotating display segments. The components of a simple planetary system consists of fixed mechanical element, a driver and driven mechanical element, enhanced by a transfer assembly.

The rotating display segments, each rotated by a corresponding planetary system concentric to each other. Segments can be nested, one inside each other, overlapping, one behind the other or at any random relation to each other that avoids interference. Each segment carries a part of the message in appropriate color and graphics. The mechanism is driven by a power source, usually an electric motor, continuously or intermittently, forward or reversing. This movement rotates each segment individually at desired speeds and direction of rotation, scrambling and unscrambling the message or display. Thus a variety of effects of the displayed scrambling or alignment can be achieved.

More than one display device can be used in any installation. These can be synchronized, mechanically or electrically, or not, depending upon the nature of the effect desired. Each can have its own mode, i.e. continuous, intermittent, reversing, etc.

The drawings and detailed description depict a five layer system. More than five layers can be used. The minimum is three layers with two moving layers.

This device can be driven by an outside source such as an electrical motor. Solenoids, pneumatic cylinders, etc. may be substituted in some applications, especially where partial revolutions or repetitive partial revolutions are required. Hand power, through a crank, is applicable in some applications.

Planetary systems can consist of a multiple of ratios and can incorporate transfer assemblies or idlers. Together a wide variety of individual relative speeds and individual directions of rotation can be achieved. Gears, pulleys and belts or timing gears and timing belts can be used.

The rotating segments are supported by brackets which are attached to the plates which are supported by the main drive shaft. There may be two or more brackets, or a truncated cone or cylinder depending upon the application.

Also, the segment surface may support three dimensional projections in a wide variety of configurations as described in the original application interacting, with two or more segments to achieve a prescribed motion.

The outer surfaces of these projections as well as the rotating segments, may have printed material, graphics or painting to achieve the desired effect.

Thus, a variety of auxiliary motions and segments can be added to the display device, with a wide variety of motions, shapes and color. These can hide, enhance, spotlight, reveal, emphasize, etc. the intended message or visual image. There can be a multiple of these links, etc. operating at the same time if care is exercised in the design to avoid interference.

Thus additional configurations and eye-catching elements can be added to the device.

DETAILED DESCRIPTION OF THE DRAWINGS

Figure 1:
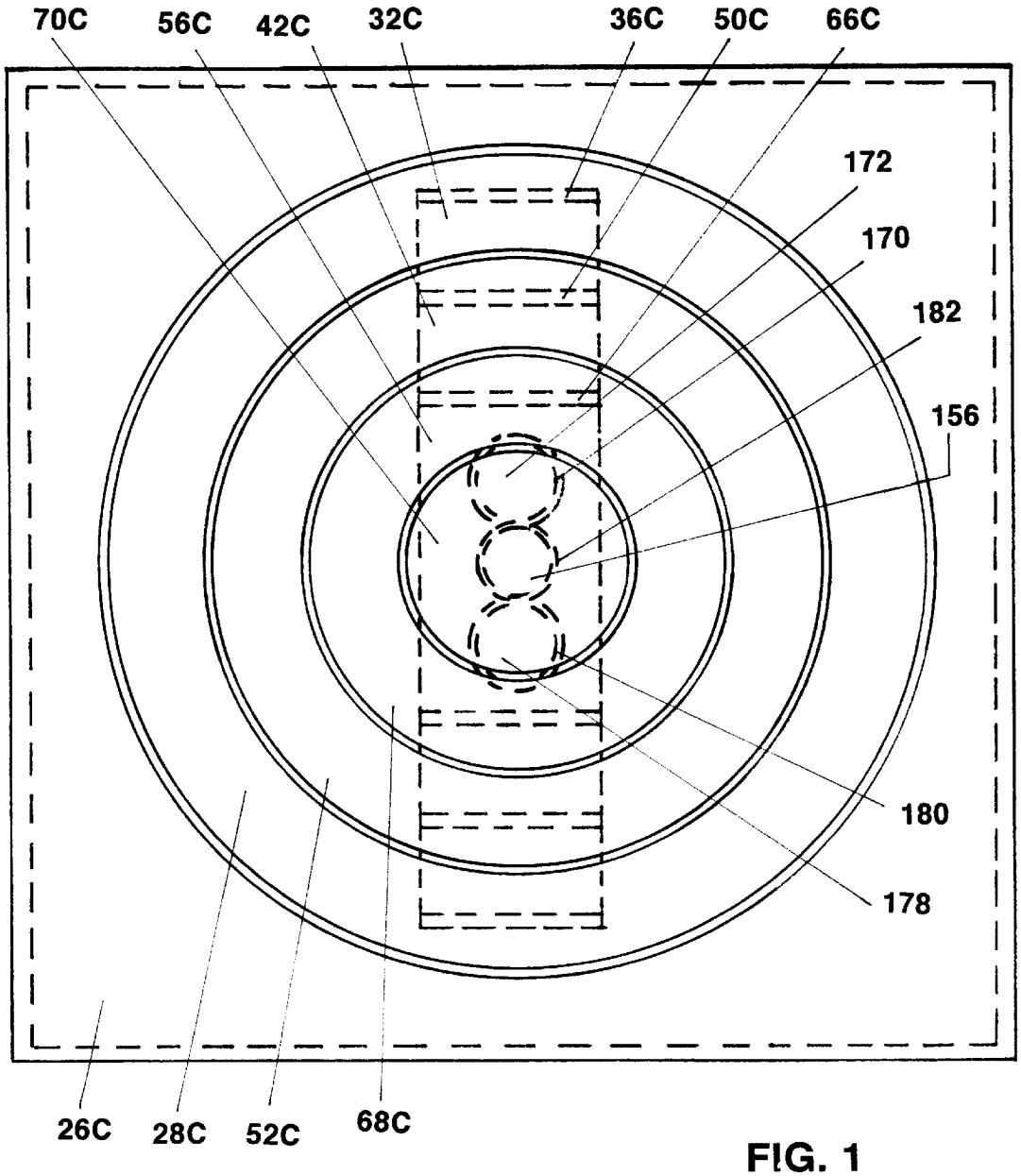
FIG. 1 is an elevation view of a nested display device with concentric rotating segments.
Figure 2:
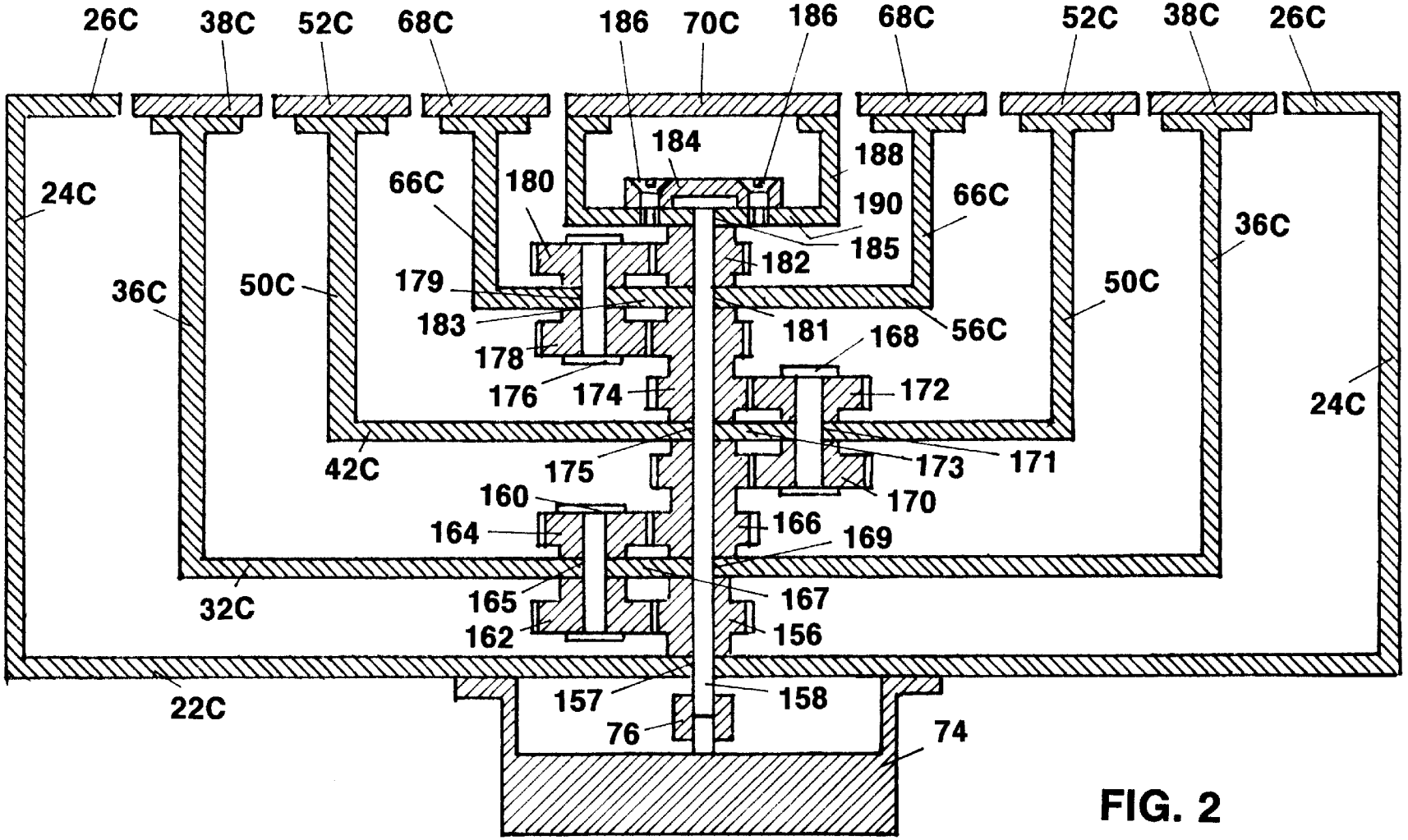
FIG. 2 is a sectional view through FIG. 1.

FIGS. 1 & 2 show a five plate system in the concentric mode. The first plate 22C is stationary and contains a fixed gear 156, mounted on its front side nearest the intermediate plate 32C, with brackets 24C, supporting a stationary segment 26C. Intermediate plate 32C is fastened to and rotated by main drive shaft 158 concentric with fixed gear 156 in first plate 22C, and passing through primary hole 157, and has brackets 36C, supporting a rotating segment 38C. Intermediate plate 32C also contains a transfer gear assembly, consisting of a transfer gear 162, fastened to idler shaft 160, which in turn is fastened to transfer gear 164. Idler shaft 160 rotates freely in secondary hole 165 in intermediate plate 32C. Transfer gear 162 meshes with fixed gear 156 and transfer gear 164 meshes with a fixed compound gear 166. Fixed compound gear 166 is attached to the side of intermediate plate 42C nearest intermediate plate 32C, and is concentric with main drive shaft 158 and primary hole 175. Intermediate plate 42C supports a bracket 50C, supporting a rotating segment 52C. Intermediate plate 42C also contains a transfer gear assembly, consisting of a transfer gear 170, fastened to idler shaft 168, which in turn is fastened to a transfer gear 172. Idler shaft 168 rotates freely in secondary hole 171 in intermediate plate 42C. Transfer gear 170 meshes with fixed gear 166 and transfer gear 172 meshes with a fixed compound gear 174 attached to intermediate plate 56C on its side nearest intermediate plate 42C and is concentric with main drive shaft 158 and primary hole 181. Intermediate plate 56C supports brackets 66C, supporting rotating segment 68C. Intermediate plate 56C also contains a transfer gear assembly, consisting of transfer gear 178, fastened to idler shaft 176, which in turn is fastened to a transfer gear 180. Idler shaft 176 rotates freely in secondary hole 179 in intermediate plate 56C. Transfer gear 178 meshes with fixed compound gear 174 and transfer gear 180 meshes with a driven gear 182 on last plate 190 on its side nearest intermediate plate 56C, and is concentric with main drive shaft 158 and primary hole 185. Last plate 190 supports brackets 188, supporting rotating segment 70C. Last plate 190 is concentric to main drive shaft 158 and primary hole 185. Retainer 184 is secured to last plate 190 by means of a screw 186, used a multiple of times. Main drive shaft 158 rotates freely within the confines created by plate 190 and retainer 184. Shaft 158 is driven by motor 74 through coupling 76.

Compound gears 166 and 174 each consist of two gears, one acting as a fixed element and the other as a driven element.

The distance between primary hole 169 and secondary hole 165 in plate 32C becomes the driver 167 in this planetary system. The distance between primary hole 175 and secondary hole 171 in plate 42C becomes the driver 173 in this planetary system. The distance between primary hole 181 and secondary hole 179 in plate 56C becomes the driver 183 in this planetary system.

| P/N | NAME |
|---|---|
| 74 | MOTOR |
| 76 | COUPLING |
| 156 | FIXED GEAR |
| 157 | PRIMARY HOLE |
| 158 | MAIN DRIVE SHAFT |
| 160 | IDLER SHAFT |
| 162 | TRANSFER GEAR |
| 164 | TRANSFER GEAR |
| 165 | SECONDARY HOLE |
| 166 | COMPOUND GEAR |
| 167 | DRIVER |
| 168 | IDLER SHAFT |

-continued

| P/N | NAME |
|---|---|
| 169 | PRIMARY HOLE |
| 170 | TRANSFER GEAR |
| 171 | SECONDARY HOLE |
| 172 | TRANSFER GEAR |
| 173 | DRIVER |
| 174 | COMPOUND GEAR |
| 175 | PRIMARY HOLE |
| 176 | IDLER SHAFT |
| 178 | TRANSFER GEAR |
| 179 | SECONDARY HOLE |
| 180 | TRANSFER GEAR |
| 181 | PRIMARY HOLE |
| 182 | DRIVEN GEAR |
| 183 | DRIVER |
| 184 | RETAINER |
| 185 | PRIMARY HOLE |
| 186 | SCREW |
| 188 | BRACKET |
| 190 | LAST PLATE |
| 22C | FIRST PLATE |
| 24C | BRACKET |
| 26C | STATIONARY SEGMENT |
| 32C | INTERMEDIATE PLATE |
| 36C | BRACKET |
| 38C | SEGMENT |
| 42C | INTERMEDIATE PLATE |
| 50C | BRACKET |
| 52C | SEGMENT |
| 56C | INTERMEDIATE PLATE |
| 66C | BRACKET |
| 68C | SEGMENT |
| 70C | SEGMENT |

I claim:

1. A planetary display device comprising in combination:

a) three plates comprising a first plate, an intermediate plate, and a last plate located parallel to one another, approximately equally spaced, one in front of each other; said first plate being positioned behind said intermediate plate and said last plate; each plate being of predetermined length and having a front side and a back side; said first plate having a primary hole located at its center longitudinally, perpendicular to said front side of said first plate; said intermediate plate having one primary hole located at its approximate center longitudinally, perpendicular to its front side; said last plate having a primary hole at its approximate center longitudinally perpendicular to its front side; said intermediate plate having one secondary hole located at a predetermined distance from its primary hole, perpendicular to its front side;

b) a motor fixed to said back side of said first plate; said motor having a motor shaft attached by means of a coupling to a main drive shaft projecting perpendicular to each plate; said main drive shaft going through and rotating freely within said primary hole of said first plate; said main drive shaft is fastened to and rotates said intermediate plate at a predetermined speed and direction of rotation; said main drive shaft is contained by a retainer fastened to said last plate, said retainer aligning said main drive shaft with said center of said last plate, and allowing said main drive shaft to rotate freely relative to said last plate;

c) a planetary system, said planetary system consisting of a fixed mechanical element, a driver, a driven mechanical element and a transfer assembly acting as an idler, selected and functionally assembled to attain predetermined speed ratios and directions of rotation; said first plate has said fixed mechanical element attached to its front side concentric to its primary hole; said intermediate plate is fastened to said main drive shaft located at its primary hole, rotating with said main drive shaft; said last plate has said driven mechanical element fastened to its back side concentric to its primary hole; the transfer assembly consists of two idler mechanical elements attached and concentric to each end of an idler shaft which rotates freely in said secondary hole of said intermediate plate, said transfer assembly transfers relative motion from said fixed mechanical element to said driven mechanical element;

d) three segments, each segment being of a predetermined size and shape, each segment being fastened by means of a set of brackets to a different one of said three plates; each bracket of said set of brackets being of predetermined length; during motion generated by said motor and said planetary system, predetermined spatial relationships of said segments, to each other, are attained without interference; each segment being rotated; and e) three partial messages, each partial message being displayed on a front, exposed surface of a different one of said three segments; in one predetermined position of all of said three segments, said three partial messages transmit an unscrambled and readable message; in any other position of said three segments, said three partial messages transmits a scrambled and unreadable message; said three partial messages being scrambled and unscrambled in a cyclical manner.

2. A planetary display device comprising in combination:

a) at least four plates comprising a first plate, at least two intermediate plates and a last plate located parallel to one another, approximately equally spaced, one in front of each other; said first plate being positioned behind said at least two intermediate plates and said last plate; each plate being of predetermined length and having a front side and a back side; said first plate having a primary hole located at its center longitudinally, perpendicular to said front side of said first plate; each said at least two intermediate plates having one primary hole located at its approximate center longitudinally, perpendicular to its front side; said last plate having a primary hole at its approximate center longitudinally perpendicular to its front side; each said at least two intermediate plates having one secondary hole located at a predetermined distance from its primary hole, perpendicular to its front side;

b) a motor fixed to said back side of said first plate; said motor having a motor shaft attached by means of a coupling to a main drive shaft projecting perpendicular to each plate; said main drive shaft going through and rotating freely within said primary hole of said first plate and each said at least two intermediate plates except for one of said at least two intermediate plates that is closest to said first plate, said main drive shaft is fastened to and rotates said one of said at least two intermediate plates that is closest to said first plate at a predetermined speed and direction of rotation; said main drive shaft is contained by a retainer fastened to said last plate, said retainer aligning said main drive shaft with said center of said last plate, and allowing said main drive shaft to rotate freely relative to said last plate;

c) a plurality of planetary systems, one planetary system for each plate of said at least two intermediate plates; each planetary system consisting of a fixed mechanical element, a driven mechanical element, a driver and a transfer assembly acting as an idler, selected and functionally assembled to attain predetermined speed ratios and directions of rotation; one of said fixed mechanical elements being located adjacent to the back side of each of said at least two intermediate plates; one of said driven mechanicals element being located adjacent to the front side of each of said at least two intermediate plates; said fixed mechanical element that is adjacent to the back side of said one of said at least two intermediate plates closest to said first plate is attached to said front side of said first plate and concentric with said primary hole of said first plate; said one of said at least two intermediate plates that is closest to said first plate is fastened to said main drive shaft located at said primary hole of said one of said at least two intermediate plates that is closest to said first plate; said one of said at least two intermediate plates that is closest to said first plate rotating with said main drive shaft; each of said at least two intermediate plates except said one of said at least two intermediate plates closest to said first plate has a compound mechanical element attached to its back side, concentric to its primary hole; each of said compound mechanical elements consist of one of said fixed mechanical elements and one of said driven mechanical elements; said last plate has said driven mechanical element that is adjacent to its back side fastened to its back side and concentric with its primary hole; each of said transfer assemblies consists of two idler mechanical elements attached and concentric to each end of an idler shaft; one of said idler shafts rotates freely in each said secondary hole of each of said at least two intermediate plates; said transfer assembly transfers relative motion from one of said fixed mechanical elements to one of said driven mechanical elements;

d) a plurality of segments, equal in number to said at least four plates; each segment being of a predetermined size and shape, each segment being fastened by means of a set of brackets to a different one of said plates; each bracket of said set of brackets being of predetermined length; during motion generated by said motor and said plurality of planetary systems, predetermined spatial relationships of said segments, to each other, are attained without interference; each segment being rotated; and e) a plurality of partial messages equal in number to said plurality of segments, each partial message being displayed on a front, exposed surface of a different one of said segments; in one predetermined position of all of said segments, said partial messages transmits an unscrambled and readable message; in any other position of all of said segments, said partial messages transmits a scrambled and unreadable message; said partial messages being scrambled and unscrambled in a cyclical manner.

* * * * *